United States Patent [19]

Haissig et al.

[11] Patent Number: 4,602,669

[45] Date of Patent: Jul. 29, 1986

[54] METHOD AND APPARATUS FOR HORIZONTAL CONTINUOUS CASTING

[75] Inventors: Manfred Haissig; Max Ahrens, both of Irvine, Calif.

[73] Assignees: Steel Casting Engineering, Orange, Calif.; Boehler Aktiengesellschaft, Düsseldorf, Fed. Rep. of Germany

[21] Appl. No.: 705,838

[22] Filed: Feb. 26, 1985

Related U.S. Application Data

[63] Continuation-in-part of Ser. No. 319,917, Nov. 10, 1981, abandoned.

[30] Foreign Application Priority Data

Nov. 18, 1980 [AT] Austria ..... 5651/80

[51] Int. Cl.[4] ..... B22D 11/128; B22D 11/20

[52] U.S. Cl. ..... 164/454; 164/413; 164/442; 164/478; 164/484

[58] Field of Search ..... 164/454, 413, 416, 440, 164/478, 484, 442

[56] References Cited

U.S. PATENT DOCUMENTS

| | | | |
|---|---|---|---|
| 2,815,551 | 12/1957 | Hessenberg et al. | 164/442 X |
| 3,575,230 | 4/1971 | Calderon | 164/440 X |
| 3,726,333 | 4/1973 | Goodrich et al. | 164/454 |
| 3,817,313 | 6/1974 | Gamble et al. | 164/416 X |
| 4,036,284 | 7/1977 | Hoffmann | 164/442 X |
| 4,119,138 | 10/1978 | Stull | 164/442 X |

FOREIGN PATENT DOCUMENTS 2340636 2/1975 Fed. Rep. of Germany .

*Primary Examiner*—Nicholas P. Godici
*Assistant Examiner*—J. Reed Batten, Jr.
*Attorney, Agent, or Firm*—Werner W. Kleeman

[57] ABSTRACT

An apparatus for continuous horizontal casting with a stationary mold and the casting method accomplished with such apparatus contemplates employing at least one gripper roll pair which directly engages a casting which is then withdrawn in steps or incrementally from the mold. At least one roll of each roll pair is driven by a stepping DC-motor to which it is directly coupled. Each casting withdrawal step can be divided into sub-steps which are controllable to produce a uniform preset speed pattern during each step.

24 Claims, 2 Drawing Figures

METHOD AND APPARATUS FOR HORIZONTAL CONTINUOUS CASTING

CROSS REFERENCE TO RELATED APPLICATION

This application is a continuation-in-part application of our copending U.S. application Ser. No. 319,917, filed Nov. 10, 1981, and entitled "Apparatus For Horizontal Continuous Casting," now abandoned.

BACKGROUND OF THE INVENTION

The present invention relates to a method and apparatus for horizontal continuous casting with a stationary guide mold and one or a plurality of pairs of gripping rolls actuated or driven by a DC-motor for the stepwise or incremental extraction or withdrawal of the continuous casting or cast strand from the mold.

In horizontal continuous casting of metals, in particular of alloys having an elevated melting point, the casting or strand, which has not yet completely solidified, is withdrawn from a stationary or an oscillating mold. In such a case the withdrawal or extraction of the casting occurs discontinuously, i.e. stepwise or incrementally. Depending on the process, either there is a pause between the individual extraction steps or the casting is pushed back over a small distance. The pushing back of the casting is intended to take into account, on the one hand, the thermal expansion of the casting, and, on the other, to effect a solid welding or fusion of the individual casting skin or shell sections formed within the continuous casting mold.

Two different basic arrangements are known for the withdrawal of the casting or strand from the mold. The first arrangement consists of jaws that engage or grip the casting and move it over a small distance. When the grip of the jaws on the casting is released and the jaws are returned to their original position, they reengage the casting, whereupon the motion cycle is repeated. This type of drive is inaccurate in view of the fact that it is necessary to move large masses, i.e. the jaws, thus requiring correspondingly large gear drives or transmissions that have a rather substantial lost motion or relatively great amount of play. Moreover, there exists the problem that the jaws will not always grip the casting at exactly the same spot, thereby producing additional inaccuracies during the extraction of the casting.

The exact movement pattern or motion cycle during the withdrawal of the casting or strand is of particular significance, not only because of production rate considerations, but also for the achievement of a high-quality continuous-casting product. If the withdrawal of the casting occurs in such a way that there does not occur any welding or fusion between the freshly formed casting skin or shell ring and the balance of the casting skin or shell, and if the casting with its casting skin is extracted further, the skin will rupture and the molten mass will emerge or break-out from the mold, whereupon the continuous casting process has to be interrupted immediately.

A more accurate control or regulation of the extraction or withdrawal of the casting can be brought about if gripping rolls directly engage the casting. The increased accuracy is due to the fact that during such a withdrawal of the casting or strand, there exists a constant contact between the casting and the gripping rolls, which contact constitutes a prerequisite for the accurate extraction or withdrawal of the casting or strand.

From German Pat. No. 1,583,611 there is known a device for the intermittent removal of a metallic casting from a mold, wherein a pair of feed rolls driven by a transmission alternatingly engage the casting and additionally perform a reciprocating motion along the casting axis. To achieve reproducibility of the casting motion, there is additionally provided a clamping device for the casting. This device is of relatively complex design and does not permit a completely accurate motion cycle, so the drawbacks already referred to still arise.

In German Pat. No. 2,340,636 there is disclosed a device for the stepwise extraction of a casting from a horizontal continuous-casting mold in which a pair of gripper rolls is actuated by a gearing or transmission driven by a stepwise operating DC-motor. For control of the motor its speed is determined in an analog manner and the angle of rotation of the gripper rolls is determined in a digital manner. The motion of the gripper rolls cannot be inferred directly from the speed of rotation of the motor in view of the fact that the system for the transmission of forces between the motor and the gripper rolls has some free motion or play. Through digital determination of the movement of the gripper rolls, however, it is possible to determine the motion of the casting which, in turn, serves for adjustment of the motor speed. In addition, this device is designed so that when a predetermined torque is exceeded a pause in the casting withdrawal motion is initiated in order to wait for the detachment of the ring of the casting skin from the mold wall. This device therefore has a complex design and is thus markedly susceptible to trouble or malfunction. As a result, in many instances the required operational safety is not provided.

German Pat. No. 1,783,032 describes a device for continuous horizontal casting by means of a stationary guiding mold and a DC-motor-actuated or driven pair of gripper rolls for performing the stepwise or incremental extraction of the casting from the mold. The DC-motor is connected with a control device which, through programmed periods and sequences, transmits pulse sequences to the DC-motor in programmed durations and sequences. The power transmission proper takes place, however, not through the DC-motor, but through an electro-hydraulic stepping motor. The term "electro-hydraulic stepping motor" is to be understood to include the combination of an electric stepping motor and a hydraulic motor, with the electric stepping motor actuating a control valve that controls the supply of pressure medium to the hydraulic motor. By controlling the pressure with the valve there can be brought about a control of the speed of the hydraulic motor. While this arrangement has the necessary torque for the withdrawal of the casting, the required accuracy of extraction or withdrawal of the casting does not always exist because fluids are not fully incompressible, thus causing inaccurate step sequences. Also this equipment is very costly.

SUMMARY OF THE INVENTION

Therefore, with the foregoing in mind, it is a primary object of the present invention to provide a new and improved method of, and apparatus for, horizontal continuous casting which does not exhibit the aforementioned drawbacks and shortcomings of the prior art.

Another and more specific object of this invention is to provide an improved method and apparatus for the substantially horizontal extraction or withdrawal of a continuous casting or strand that is characterized by a particularly simple structure, yet ensures accurate extraction of the casting or strand from the substantially horizontal continuous casting mold.

Yet a further significant object of the present invention aims at providing a new and improved construction of an apparatus of the character described which is relatively simple in construction and design, extremely economical to fabricate, highly reliable in operation, not readily subject to breakdown or malfunction and requires a minimum of maintenance and servicing.

Now in order to implement these and still further objects of the invention, which will become more readily apparent as the description proceeds, the apparatus for horizontal continuous casting is manifested by the features that at least one gripper roll is arranged on an extraction motor shaft or is directly coupled thereto. In this way there is achieved not only a very simple structure, but also a direct relation between the angle of rotation of the motor and the motion of the casting. As a result, the casting motion can be supervised very simply and accurately. Also, control or regulation operations can be carried out very precisely and are always reproducible, thereby readily achieving accurate step or increment sequences.

In an illustrative embodiment of the invention a stepwise or incrementally operating DC-motor is connected or coupled directly to one roll of an extraction or withdrawal roll pair and is driven or regulated by a control device that transmits control signals in programmed durations and sequences. The control signals are arranged or configured to produce casting extraction steps or increments that are each subdivided into partial steps that are individually controllable or regulatable.

A pulse transmitter for supplying digital information concerning the angle of rotation of the motor and a forward/backward counter series-connected thereto, form part of the control device. The forward/backward counter which stores the motion position or angle of rotation information is also connected with a microprocessor which, in turn, is connected with a ROM (Read-Only Memory) that stores information concerning the preset pulses needed for each partial step or increment of the motor. By means of signals corresponding to the difference between the counter status or state (i.e. the motor position) and the preset pulses, the microprocessor, preferably via a digital-analog converter, controls a pulse-width modulating DC-current amplifier that supplies the driving or power signal to the DC-motor.

In this way, and at relatively low cost, a highly accurate control of the motor is achieved via a pulse-width modulating DC-current amplifier that produces pulses per unit of time, whose pulse widths are modulated by the control device in such a way that there is brought about a uniform change in the rate of speed of the casting or strand during each step or increment. Control of these pulses is effective since each casting withdrawal step or increment is subdivided into partial steps, whereby the desired speed profile in each step or increment can be reproducibly maintained. Consequently, an optimum casting or strand surface can be obtained, even in the area of abutment of the individual annular casting sections, and no troublesome notches are created in the surface of the casting. With this arrangement the possibility exists that, following each partial step, there can take place a correction of the casting withdrawal or extraction length of the withdrawn casting or strand for the subsequent partial step, which means that each step can be made to correspond precisely to the specified conditions.

For the automatic control of the start-up cycle it is advantageous if the microprocessor is connected with another ROM that stores the step sequences for the start-up cycle.

In order to adapt the apparatus or device in a simple manner to the processing of different alloys without requiring any specially trained personnel, provision has been made, in accordance with another characteristic of the invention, whereby the microprocessor is also connected via a time-signal generator to a time-interval selector which serves for presetting the casting withdrawal or extraction period for the selected alloys. Thus, the required adjustment can be brought about through the simple setting of a withdrawal time or time interval for a specific alloy without requiring any major intervention in the controls to achieve this purpose.

BRIEF DESCRIPTION OF THE DRAWINGS

The foregoing and other features and objects of an exemplary embodiment of the invention are explained below in greater detail with reference to the drawings wherein.

DESCRIPTION OF THE PREFERRED EMBODIMENTS

Figure 1:
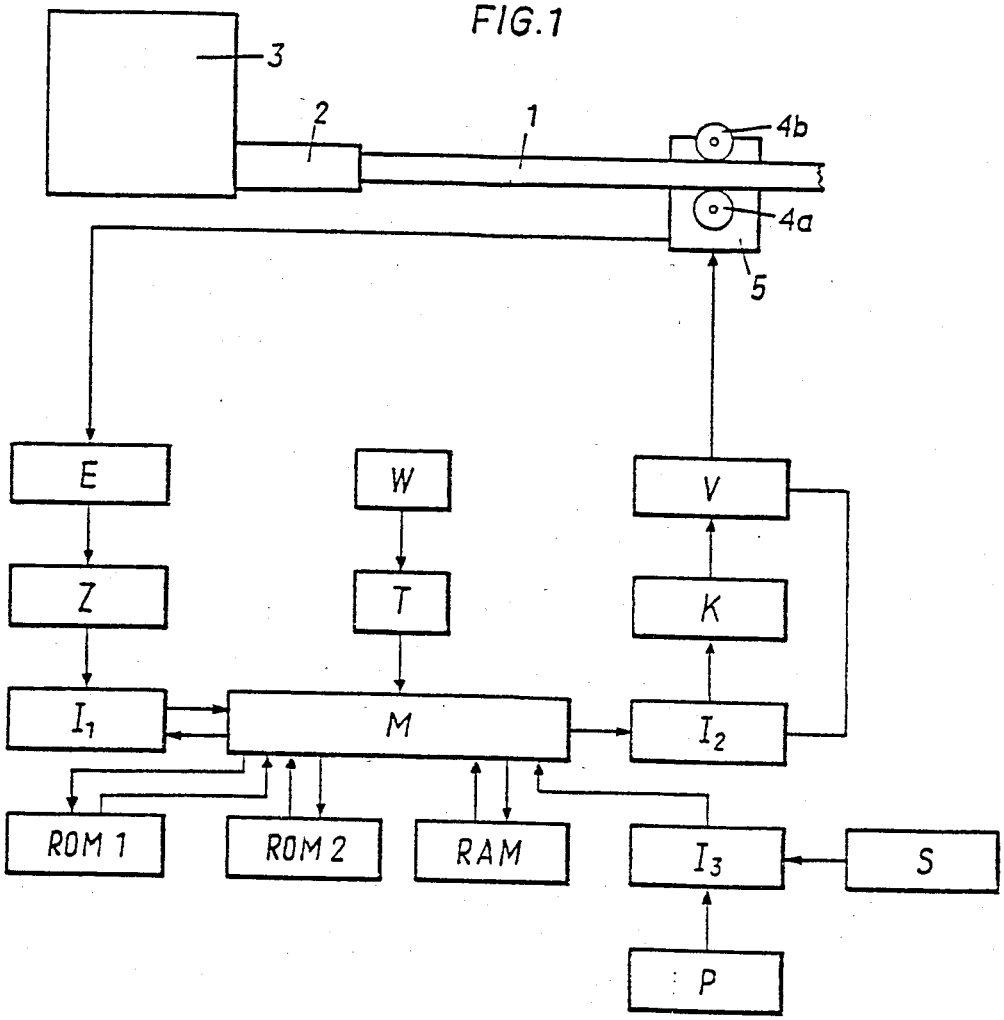
FIG. 1 shows a wiring block diagram or block circuit diagram of a control or regulation system according to the invention.

Describing now the drawings, it is to be understood that, to simplify the showing thereof, only enough of the structure of the continuous casting apparatus for horizontal continuous casting of strands has been illustrated therein as is needed to enable one skilled in the art to readily understand the underlying principles and concepts of this invention. Turning now specifically to FIG. 1 of the drawings, the continuous casting apparatus illustrated therein by way of example and not limitation will be seen to perform an operation in which a continuous casting or strand 1 is drawn out substantially horizontally in steps or incrementally from a stationary guide or continuous casting mold 2 that is fixed to a melt container or tundish 3. In this operation, a pair of gripper or pinch rolls 4*a*, 4*b* directly engage the continuous casting or strand 1. The gripper or pinch roll 4*a* is directly coupled with a DC-motor 5. This DC-motor 5 is thus importantly devoid of any transmission or gearing and by directly coupling the gripper or pinch roll 4*a* with such transmission-less DC-motor 5, i.e. to its output shaft or output side, there is afforded an extremely accurate regulation of the withdrawal motion of the casting or strand 1 departing from the continuous casting mold 2, since there do not arise any slip errors as would be the case if an intermediate transmission or gearing were employed as was heretofore the case with the prior art equipment. As a result of the just-explained direct drive of the gripper or pinch roll 4*a* there is also not necessary any slip-compensation circuitry and the entire regulation operation and related apparatus is appreciably simplified in its construction and more accurate in operation.

Furthermore, the directly motor-coupled gripper or pinch roll 4*a* of the first roller pair 4*a*, 4*b* engaging the casting or strand 1 which has departed from the continuous casting mold 2, advantageously is positioned at the region of the emerging casting or strand 1 where there is still present an internal liquid metal core or sump, in other words relatively close to the continuous casting mold 2 and the melt container or tundish 3. As a result of this relatively close spacing of the gripper or pinch roll 4*a* from the mold 2 there is beneficially precluded or at least appreciably minimized the possibility that undesirable external effects, such as air drafts in the production hall or the like, will adversely act upon the emerging casting 1. These air drafts or currents otherwise might, for instance, unintentionally cool the emerging casting 1 and result in uncontrolled length changes thereof, with attendant reduction in the otherwise attainable precise casting withdrawal movement because of the previously explained beneficial direct coupling of the gripper roll 4*a* with the transmission-less DC-motor 5.

This DC-motor 5 is connected with an encoder E that transmits 20,000 pulses per revolution of such motor 5 to a forward/backward or up/down counter Z. Information or data concerning the preset pulses for each individual partial step or increment is stored in a ROM (Read-Only Memory) 1. A microprocessor M compares the preset pulse data with the encoder signal delivered to it via an interface or interface circuit $I_1$, and generates a difference signal related to how far the encoder signal, and hence the motor 5, is away from the ideal speed curve determined by the preset pulse information or data. As a function of the movement of the casting or strand 1, either forward or backward, the microprocessor M either reduces or increases the width of the pulses supplied to the motor 5 in order to force this motor 5 into the desired speed pattern. The microprocessor M supplies the pulse-width modulated signal to the DC-motor 5 via a pulse generator including an interface or interface circuit $I_2$, a digital-analog converter K for converting the digital output signals of the microprocessor to an analog signal, and a pulse-width modulating DC-amplifier V under the control of the analog signal from D/A-converter K.

The microprocessor M is also connected via a time-interval selector W with a time-signal generator T. By means of the time-interval selector W, it is possible to set the duration of the withdrawal period as a function of the alloy to be processed.

In a ROM (Read-Only Memory) 2 there is stored the exact motion sequence for the start-up process. In a RAM (Random-Access Memory) there is stored the number of forwardly and/or rearwardly required partial steps in each casting withdrawal step or increment. Starting of the process is brought about via the on-off switch S and the interface or interface circuit $I_3$ according to a program set by a program selector P.

The stepwise or incrementally operating DC-motor 5 need not necessarily have an output or drive shaft of its own. Instead in the exemplary embodiment for instance the rotor, which contains the windings that are supplied with the current pulses from amplifier V via four suitable not particularly shown brushes, has a cylindrical recess for receiving in a form-locking manner the shaft of the gripper or pinch roll 4*a*. The outer diameter of the rotor is about 27 inches (approximately. 70 cm), its inner diameter is about 18 inches (approximately. 50 cm). The stator has a permanent magnet element. Due to this design of the DC-motor 5, a high torque can be achieved even during the motor starting cycle.

Figure 2:
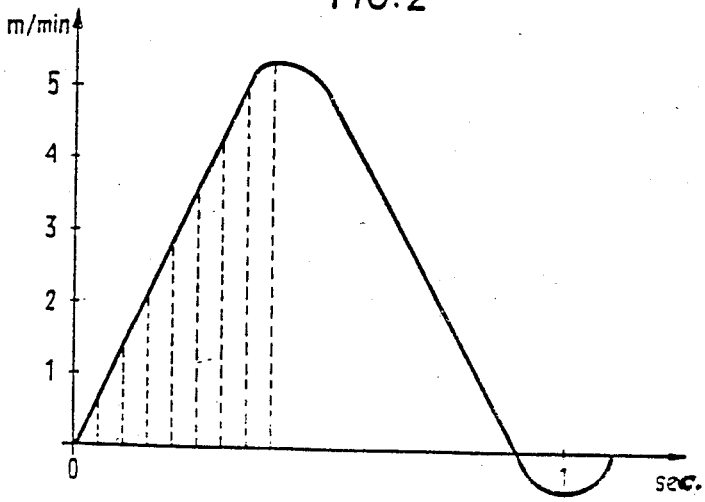
FIG. 2 shows a diagram of the preset speed pattern produced by the system of FIG. 1 in the course of one casting withdrawal or extraction step.

The diagram represented in FIG. 2 illustrates the preset speed pattern repeated during each step or increment in the withdrawal of the casting. Movement is slowly imparted to the casting until a maximum rate has been attained, whereupon the speed is slowly reduced until the casting is stopped and then pushed back as represented by the negative portion of the curve. The step or increment as a whole takes 1.1 seconds and the various partial steps are spaced every 1/20th of a second or less. Because of the continuous change in the casting or strand speed, a shock-like motion of the liquid metal within the very thin and mechanically unstable skin of the casting is avoided, and a homogeneous build-up of the casting can be brought about.

While the invention has been particularly shown and described with reference to a preferred embodiment thereof, it will be understood by those skilled in the art that various changes in form and details may be made therein without departing from the spirit and scope of the invention.

What is claimed is:

1. A method of continuous horizontal casting wherein a pair of pinch rolls engages the continuously cast strand to incrementally withdraw the continuously cast strand from a stationary mold in discrete withdrawal steps in a withdrawal direction, comprising the steps of:

directly driving one of the pinch rolls of the pinch roll pair free of slip by means of a DC-motor;

sensing an angle of rotation of said DC-motor;

transmitting signal pulse information corresponding to said sensed angle of rotation to a microprocessor;

comparing by means of said microprocessor said signal pulse information to predetermined information stored in a memory register; and regulating as a function of said comparison step a pulse-width modulation of driving current for said DC-motor.

2. In a method of continuous horizontal casting wherein a pair of pinch rolls intermittently operated by a DC-motor engages the continuously cast strand to incrementally withdraw the continuously cast strand from a stationary mold in discrete withdrawal steps in a withdrawal direction, the improvement which comprises:

directly driving one of the pinch rolls of the pinch roll pair free of slip by means of a transmission-less DC-motor;

regulating the transmission-less DC-motor so as to perform a first portion of each said discrete withdrawal step by driving said one pinch roll of said pair of pinch rolls so as to impart a gradually increasing withdrawal speed to said strand in said direction of withdrawal;

regulating the transmission-less DC-motor to perform a second portion of each said discrete withdrawal step by driving said one pinch roll of said pair of pinch rolls so as to impart a gradually decreasing withdrawal speed to said cast strand in said withdrawal direction; and regulating the transmission-less DC-motor to perform a third portion of each said discrete withdrawal step by driving said one pinch roll of said pair of pinch rolls to briefly impart a direction of motion to said cast strand which is opposite to said withdrawal direction.

3. The method as defined in claim 2, wherein:

said gradually increasing withdrawal speed is a linearly increasing withdrawal speed.

4. The method as defined in claim 2, wherein:

said gradually decreasing withdrawal speed is a linearly decreasing withdrawal speed.

5. The method as defined in claim 2, wherein:

said method steps of performing a first portion of each said discrete withdrawal step, a second portion of each said discrete withdrawal step and a third portion of each said discrete withdrawal step each include transmitting control signals of programmable duration and sequence for regulating said transmission-less DC-motor.

6. The method as defined in claim 2, wherein:

said step of performing said first portion of each said discrete withdrawal step is performed in a plurality of short partial steps.

7. The method as defined in claim 2, wherein:

said step of performing said second portion of each said discrete withdrawal step is performed in a plurality of short partial steps.

8. The method as defined in claim 2, wherein:

said step of performing said third portion of each said discrete withdrawal step is performed in a plurality of short partial steps.

9. The method as defined in claim 2, furthering including the step of:

engaging at least the one directly driven pinch roll with the cast strand at a location where it still contains a liquid metal pools.

10. An apparatus for horizontal continuous casting, comprising:

a stationary mold for forming a casting emerging from the stationary mold;

at least one pair of gripper rolls for directly engaging said emerging casting;

a stepwise operating DC-motor directly driving at least one of the gripper rolls of said at least one pair of gripper rolls for stepwise withdrawal of said casting from the stationary mold;

said DC-motor and said at least one gripper roll of said at least one gripper roll pair being directly coupled to one another to effect movement of said casting in direct relationship to rotation of said DC-motor;

control means provided for said stepwise operating DC-motor;

said control means transmitting control signals of programmable duration and sequence to said DC-motor, such that each operating step of said DC-motor comprises a first portion in which the speed of withdrawal of the casting is gradually increased from zero to a maximum, a second portion in which the speed of withdrawal is gradually decreased from the maximum to zero, and a third portion in which the direction of movement of the casting is reversed; and the increase and decrease in speed of withdrawal of the casting each being carried out in a plurality of short partial steps.

11. The apparatus as defined in claim 10, wherein:

said at least one gripper roll and the DC-motor have a common shaft.

12. The apparatus as defined in claim 10, wherein:

said at least one gripper roll engages the casting at a location where it emerges from the stationary mold while still internally containing therein a liquid metal core.

13. The apparatus as defined in claim 10, wherein:

said control means comprises:

an angular encoder means for generating digital pulse information related to the angular position of the DC-motor;

a forward/backward counter means for receiving and counting the digital pulse information from the encoder means;

a read-only memory that stores preset digital pulse information for partial steps of a certain preset speed pattern for each step of the DC-motor;

a microprocessor receiving the digital pulse information from the counter and said read-only memory;

said microprocessor generating output signals corresponding to the difference between the digital pulse information stored in the counter and said read-only memory; and a pulse generator means for driving the DC-motor in response to the microprocessor output signals so as to move the casting according to said preset speed pattern.

14. The apparatus as defined in claim 13, wherein:

said pulse generator means comprises:

a digital-analog converter for receiving digital output signals from the microprocessor and converting them into an analog signal; and a pulse-width modulating DC-current amplifier controlled by said analog signal so as to supply current pulses to said DC-motor.

15. The apparatus as defined in claim 13, further including:

a time-signal generator means and a time-interval selector means operatively connected with the microprocessor for presetting a withdrawal time for the casting.

16. The apparatus as defined in claim 13, further including:

an additional read-only memory connected with the microprocessor and in which there is stored a step sequence for start-up of the casting process.

17. The apparatus as defined in claim 16, further including:

a time-signal generator means and a time-interval selector means operatively connected with the microprocessor for presetting a withdrawal time for the casting.

18. An apparatus for horizontal continuous casting, comprising:

a mold for forming a casting emerging from the mold;

at least one pair of gripper rolls for directly engaging said casting at a region of said emerging casting where said casting still internally contains a liquid core;

an incrementally operating transmission-less DC-motor directly driving at least one of the gripper rolls of said at least one pair of gripper rolls for incremental withdrawal of said casting from the stationary mold;

said DC-motor and said at least one gripper roll of said at least one gripper roll pair being directly coupled to one another to effect movement of said casting in direct relationship to rotation of said DC-motor;

control means provided for said incrementally operating DC-motor;

said control means transmitting control signals of programmable duration and sequence to said DC-motor, such that each operating increment of said DC-motor comprises a first portion in which the speed of withdrawal of the casting is gradually increased from zero to a maximum, a second portion in which the speed of withdrawal is gradually decreased from the maximum to zero, and a third portion in which the direction of movement of the casting is reversed; and the increase and decrease in speed of withdrawal of the casting each being carried out in a plurality of short partial increments.

19. The apparatus as defined in claim 18, wherein:

said at least one gripper roll and the DC-motor have a common shaft.

20. The apparatus as defined in claim 18, wherein:

said control means comprises:

an angular encoder means for generating digital pulse information related to the angular position of the DC-motor;

a forward/backward counter means for receiving and counting the digital pulse information from the encoder means;

a read-only memory that stores preset digital pulse information for partial increments of a certain preset speed pattern for each withdrawal increment of the DC-motor;

a microprocessor receiving the digital pulse information from the counter and said read-only memory;

said microprocessor generating output signals corresponding to the difference between the digital pulse information stored in the counter and said read-only memory; and a pulse generator means for driving the DC-motor in response to the microprocessor output signals so as to move the casting according to said preset speed pattern.

21. The apparatus as defined in claim 20, wherein:

said pulse generator means comprises:

a digital-analog converter for receiving digital output signals from the microprocessor and converting them into an analog signal; and a pulse-width modulating DC-current amplifier controlled by said analog signal so as to supply current pulses to said DC-motor.

22. The apparatus as defined in claim 20, further including:

a time-signal generator means and a time-interval selector means operatively connected with the microprocessor for presetting a withdrawal time for the casting.

23. The apparatus as defined in claim 20, further including:

an additional read-only memory connected with the microprocessor and in which there is stored an increment sequence for start-up of the casting process.

24. The apparatus as defined in claim 23, further including:

a time-signal generator means and a time-interval selector means operatively connected with the microprocessor for presetting a withdrawal time for the casting.

* * * * *